US006229493B1

(12) United States Patent
Iijima

(10) Patent No.: US 6,229,493 B1
(45) Date of Patent: May 8, 2001

(54) GLASS ANTENNA DEVICE FOR VEHICLE

(75) Inventor: Hiroshi Iijima, Osaka (JP)

(73) Assignee: Nippon Sheet Glass Co., Ltd. (JP)

( * ) Notice: Subject to any disclaimer, the term of this patent is extended or adjusted under 35 U.S.C. 154(b) by 0 days.

(21) Appl. No.: 09/440,421

(22) Filed: Nov. 15, 1999

(30) Foreign Application Priority Data

Nov. 16, 1998 (JP) ..... 10-325330

(51) Int. Cl.[7] ..... H01Q 1/32
(52) U.S. Cl. ..... 343/713; 343/704
(58) Field of Search ..... 343/713, 704, 343/711, 712, 850, 856, 860; 333/119, 132; H01Q 1/32

(56) References Cited

U.S. PATENT DOCUMENTS 5,083,134 * 1/1992 Saitou et al. ..... 343/713
5,258,728 * 11/1993 Taniyoshi et al. ..... 333/132
5,781,160 * 7/1998 Walton ..... 343/713
5,945,957 * 8/1999 Kakizawa ..... 343/713

FOREIGN PATENT DOCUMENTS 0854534 7/1998 (EP) .
0942486 9/1999 (EP) .
9182222 1/1997 (JP) .

* cited by examiner

*Primary Examiner*—Tho Phan
(74) *Attorney, Agent, or Firm*—Adams & Wilks

(57) ABSTRACT

A glass antenna device for a vehicle includes an FM reception antenna and an AM reception antenna both provided on a window glass of the vehicle, an AM-antenna-side impedance converter and a receiver-side impedance converter disposed at a different position from the window glass, a first coaxial cable interconnecting the two impedance converters, a receiver, and a second coaxial cable interconnecting the receiver-side impedance converter and the receiver. The distributed capacitance of the second coaxial cable is not in excess of 10 pF, so that the vehicle glass antenna device can reduce transmission loss at transmission lines, thus ensuring reception of AM signals at high sensitivity with little attenuation.

28 Claims, 4 Drawing Sheets

GLASS ANTENNA DEVICE FOR VEHICLE

BACKGROUND OF THE INVENTION

1. Field of the Invention

The present invention relates generally to a glass antenna device for vehicles of the type wherein two antennas are provided on the same surface of a fixed window glass, such as a rear window glass or a side window glass, for the reception of FM and TV broadcasts and AM broadcasts, respectively, and a transformer is connected to transmission lines extending from the two antennas for performing the impedance conversion of the transmission lines. More particularly, it relates to a vehicle window glass antenna device designed to prevent reductions in the AM broadcasts reception sensitivity.

2. Description of the Related Art

Conventional vehicle window glass antenna devices are equipped with a choke coil to prevent a reduction in the reception sensitivity. The present assignee has proposed in Japanese Patent Laid-open Publication No. HEI 9-018222 a glass antenna device equipped with a transformer devoid of choke coil, such as shown here in FIG. 4 of the accompanying drawings.

As shown in FIG. 4, the proposed glass antenna device 51 includes an exclusive antenna 53, a compatible antenna 52 formed by defogging heater conductors 55 connected to bus bars 54 (54*a*, 54*b*), and an impedance conversion transformer 57. A primary winding of the transformer 57 is connected at its one end 57*a* to the exclusive antenna 53 and at its middle point 57*b* to the compatible antenna 52 via a lead. A secondary winding of the transformer 57 has terminals 57*c*, 57*d* connected to a center conductor 56*a* and an outer conductor 56*b* of a coaxial feeder cable 56. By virtue of the impedance conversion achieved by the impedance conversion transformer 57, a practically sufficient degree of reception sensitivity can be obtained even though a conventional choke coil is eliminated.

Because of the impedance conversion transformer associated with the exclusive antenna to eliminate a choke coil, the glass antenna device disclosed in Japanese Patent Laid-open Publication No. HEI 9-018222 achieves practically sufficient reception sensitivity.

However, there is room for improvement in that signal attenuation may occur when a cable interconnecting a receiver-side impedance conversion transformer and an AM receiver is long and hence has a large distribution capacitance.

SUMMARY OF THE INVENTION

It is accordingly an object of the present invention to provide a glass antenna device for a vehicle, which is capable of preventing a reduction in the AM reception sensitivity.

To attain the object, the present invention provides a glass antenna device for a vehicle, comprising: an FM antenna and an AM antenna both provided on the same surface of a rear window glass or a fixed window glass at a different position of the vehicle for the reception of FM broadcasts and AM broadcasts, respectively; and an antenna-side impedance conversion transformer connected to the FM antenna and the AM antenna through respective transmission lines for performing the impedance conversion of the transmission lines, and a receiver-side impedance conversion transformer electrically connected to the antenna-side impedance conversion transformer. A cable interconnecting the receiver-side impedance conversion transformer and the input terminal of a receiver for the reception of AM broadcast has a distributed capacitance not in excess of 10 pF.

Because of the distributing capacitance of the cable is not in excess of 10 pF, losses in the transmission lines can be reduced. Thus, the glass antenna device can achieve reception of AM broadcasts at high sensitivity with little attenuation of AM reception signals.

The above and other features and advantages of the present invention will become manifest to those versed in the art upon making reference to the following description and accompanying sheet of drawings in which preferred structural embodiments incorporating the principle of the invention are shown by way of illustrative examples.

DETAILED DESCRIPTION OF THE PREFERRED EMBODIMENTS

Certain preferred embodiments of the present invention will be described in greater detail with reference to the accompanying sheets of drawings.

The present invention seeks to provide a glass antenna device for vehicles wherein an FM broadcast reception antenna (for a short-wave band) and an AM broadcast reception antenna (for a medium-wave band) are provided on the same surface of a rear window glass or a fixed window glass of a vehicle, and transformers are connected to the FM and AM broadcast reception antennas for performing impedance matching. The glass antenna device includes a cable interconnecting an output side of the impedance-matched transformers and a receiver. The cable has a distributed capacitance reduced to such an extent that interference with noises and attenuation of signals do not occur and, hence, the glass antenna device can achieve reception of AM broadcast signals at high reception sensitivity.

Figure 1:
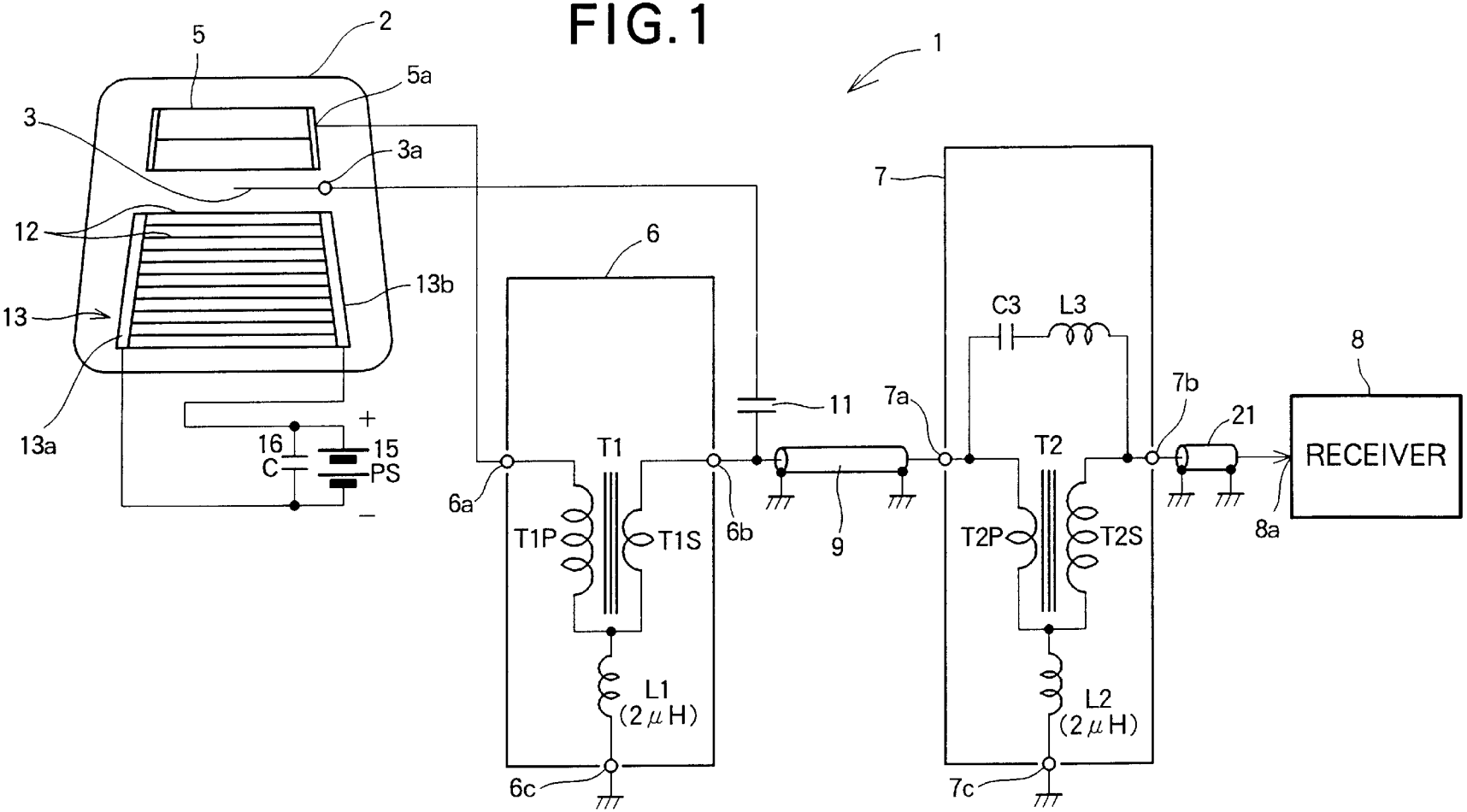
FIG. 1 is a diagrammatical view showing the general arrangement of a glass antenna device for a vehicle according to the present invention.

Referring now to FIG. 1, there is shown a glass antenna device 1 for a vehicle according to a first embodiment of the present invention. The glass antenna device 1 includes an AM reception antenna 5 and an FM reception antenna 3 both formed on a window glass 2 of the vehicle, an AM-antenna-side impedance conversion circuit or converter 6 disposed at a position other than the window glass 2, a receiver-side impedance conversion circuit or converter 7, a coaxial cable 9 interconnecting the impedance converters 6 and 7, a receiver 8, and a coaxial cable 21 interconnecting the receiver-side impedance converter 7 and the receiver 8.

The glass antenna device 1 further has an AM feeding point 3*a* and an FM feeding point 5*a* formed on the window glass together with the AM and FM reception antennas 5 and 3 in the form of patterns of conductor. A pattern of parallel spaced defogging heater elements 12 connected at opposite ends to a pair of bus bars 13*a* and 13*b* is also formed on the window glass 2.

The conductor patterns of the AM and FM reception antennas 5 and 3 are formed by a conductive member, such as a conductive wire, a conductive metal fine line, or a conductive metal foil, which is formed by dissolving fine particles of silver and a low melting point glass powder with an organic solvent to form a conductive paste, then screen-printing the conductive paste onto the window glass 2, followed by baking. The conductor patterns of wire may be replaced by transparent planar conductor patterns.

The defogging heater elements 12 are formed by a fine nichrome wire or a conductive paste of silver screen-printed on the window glass 2 followed by baking. The heater elements 12 are heated by power supplied from a dc power supply (car battery) 15 via the bus bars 13 (13*a* and 13*b*). A capacitor 16 is connected between two electrodes of the battery 15 to absorb noise.

The AM-antenna-side impedance converter 6 is provided between the feeding point 5*a* of the AM reception antenna 5 and the coaxial cable 9. The feeding point 5*a* of the AM reception antenna 5 is connected to an input terminal 6*a* of the AM-antenna-side impedance converter 6.

The receiver-side impedance converter 7 has primary terminals 7*a* and 7*c* connected to the coaxial cable 9.

The AM-antenna-side impedance converter 6 includes a transformer T1 for transmitting reception signals at AM broadcast band, and a choke coil L1 that presents a high impedance to frequencies in the FM broadcast band to compensate for or offset a reduction in the FM reception sensitivity resulting from distributed capacitances of the transformer T1 and cables.

The transformer T1 used in the illustrated embodiment includes a primary winding T1P and a secondary winding T1S which are wound to provide a turn ratio of 9:1. The primary winding T1P has one end connected to the input terminal 6*a* of the AM-antenna-side impedance converter 6. One end of the secondary winding T1S is connected to an output terminal 6*b* of the AM-antenna-side impedance converter 6. The other end of the primary winding TiP and the other end of the secondary winding T1S are connected in common to a ground terminal 6*c* through the choke coil L1. The choke coil L1 used in the illustrated embodiment has an inductance of the order of 2 microhenry (2 $\mu$H). The ground terminal 6*c* is connected to, for example, a body earth of the vehicle.

A transformer T2 of the receiver-side impedance converter 7 is the same in construction as the transformer T1 of the AM-antenna-side impedance transformer 6, but the transformer T2 is connected in reverse to the transformer T1.

An output terminal 7*b* of the receiver-side impedance converter 7 and an input terminal 8*a* of the receiver 8 are connected by the coaxial cable 21. The coaxial cable 21 has a small distributed capacitance.

The output terminal 6*b* of the AM-antenna-side impedance converter 6 and the feeding point 3*a* of the FM reception antenna 3 are connected together via an FM antenna connection capacitor 11.

The receiver-side impedance converter 7 includes a transformer T2 for transmitting reception signals at AM broadcast band, and a choke coil L2 that presents a high impedance to frequencies in the FM broadcast band, and a C-L oscillation circuit consisting of a series connected capacitor C3 and choke coil L3 pair for passing the reception signals at FM broadcast band.

The transformer T2 used in the illustrated embodiment includes a primary winding T2P and a secondary winding T2S which are,wound to provide a turn ratio of 1:9. The primary winding T2P has one end connected to the input terminal 7*a* of the receiver-side impedance converter 7. One end of the secondary winding T2S is connected to the output terminal 7*b* of the receiver-side impedance converter 7. The other end of the primary winding T2P and the other end of the secondary winding T2S are connected in common to the ground terminal 7*c* through the choke coil L2. The choke coil L2 used in the illustrated embodiment has an inductance of the order of 2 microhenry (2 $\mu$H). The ground terminal 7*c* is connected to, for example, the body earth of the vehicle.

The C-L oscillator circuit consisting of the capacitor C3 and choke coil L3 connected in series for passing FM reception signals is connected at one end to the input terminal 7*a* and at the other end to the output terminal 7*b*.

The capacitor C3 used in the C-L oscillator circuit has a capacitance of the order of 18 picofarad (18 pF). The choke coil L3 of the L-C oscillator circuit has an inductance of the order of 0.1 microhenry (0.1 $\mu$H). The secondary terminal 7B and the ground terminal 7C of the receiver-side impedance converter are connected to one end of the coaxial cable 21. The coaxial cable 21 has a center conductor 21 connected to the input terminal (antenna connection terminal) 8*a* of the receiver 8.

The AM-antenna-side impedance converter 6 is disposed in the vicinity of the window glass 2 (rear window glass) on which the AM reception antenna 5 is formed.

The coaxial cable 9 interconnecting the output terminal 6*b* of the AM-antenna-side impedance converter 6 and the input terminal 7*a* of the receiver-side impedance converter 7 has a length of about 4 meters.

A reception signal at an AM broadcast band, which is received at the AM antenna 5 formed on the window glass 2, is supplied to the input terminal 8*a* of the receiver 8 successively through the transformer T1, the coaxial cable 9, the transformer T2 and the coaxial cable 21.

As described above, the vehicle glass antenna device 1 of the present invention includes an AM reception antenna 5 and an FM reception antenna 3 both formed on a rear window glass 2 of the vehicle, an AM-antenna-side impedance converter 6 connected to the AM reception antenna 5, a receiver-side impedance converter 7 connected with the AM-antenna-side impedance converter 6 by a coaxial cable 9, and a receiver 8 connected with the receiver-side impedance converter 7 by a coaxial cable 21. The coaxial cable 21 has a distributed capacitance so limited as to prevent the occurrence of noise-mixing and signal-attenuation.

Figure 2:
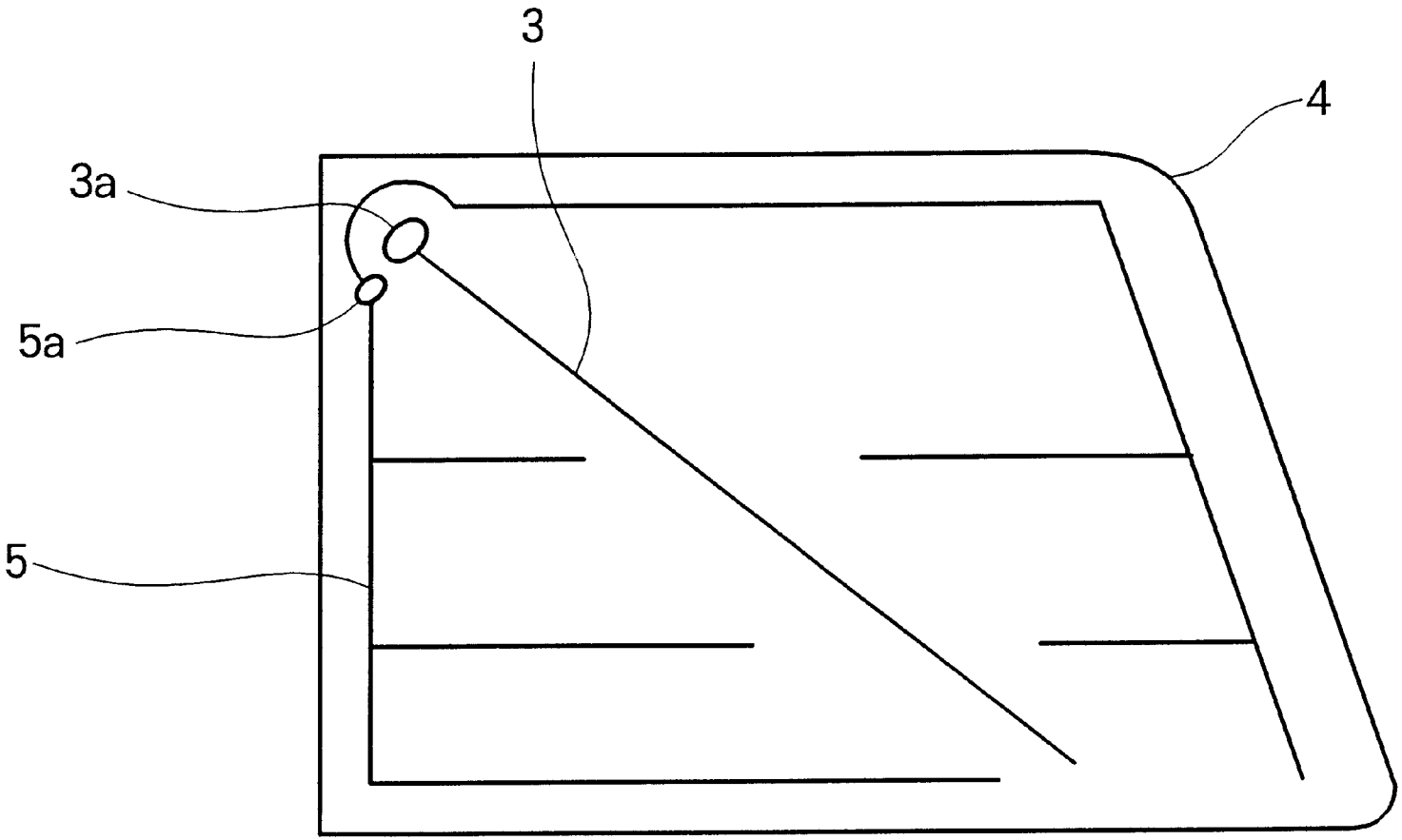
FIG. 2 is a diagrammatical view showing the pattern of an AM/FM antenna arranged in a vehicle side window glass.

FIG. 2 diagrammatically show an arrangement pattern of AM and FM antennas 5 and 3 formed on a side window glass 4 of the vehicle when viewed from the inside of the vehicle.

The AM reception antenna 5 has an antenna pattern composed of a main strip extending along an outer periphery of the side window glass 4, and a plurality of parallel spaced linear strips branched like a comb from the body strip. The FM reception antenna 3 has a pattern composed of a single linear strip disposed interiorly of the AM antenna pattern and extending diagonally to the AM antenna pattern. The AM and FM antennas 5 and 3 having such antenna patterns are able to achieve high reception sensitivity for all frequency ranges in the AM and FM broadcast bands.

In the case where an AM reception antenna and an FM reception antenna are provided on a fixed window glass (such as a side window glass including a glass panel of an opera window or a quarter window), it is possible to keep the AM and FM antennas 18, 5 far distant from vehicle electrical equipments including a rear wiper, stop lamps and indicators, as well as a wire harness extending to the electrical equipments. with this arrangement, noises generated from the electric equipments are unlikely to be mixed in transmission lines of the antenna device.

Figure 3:
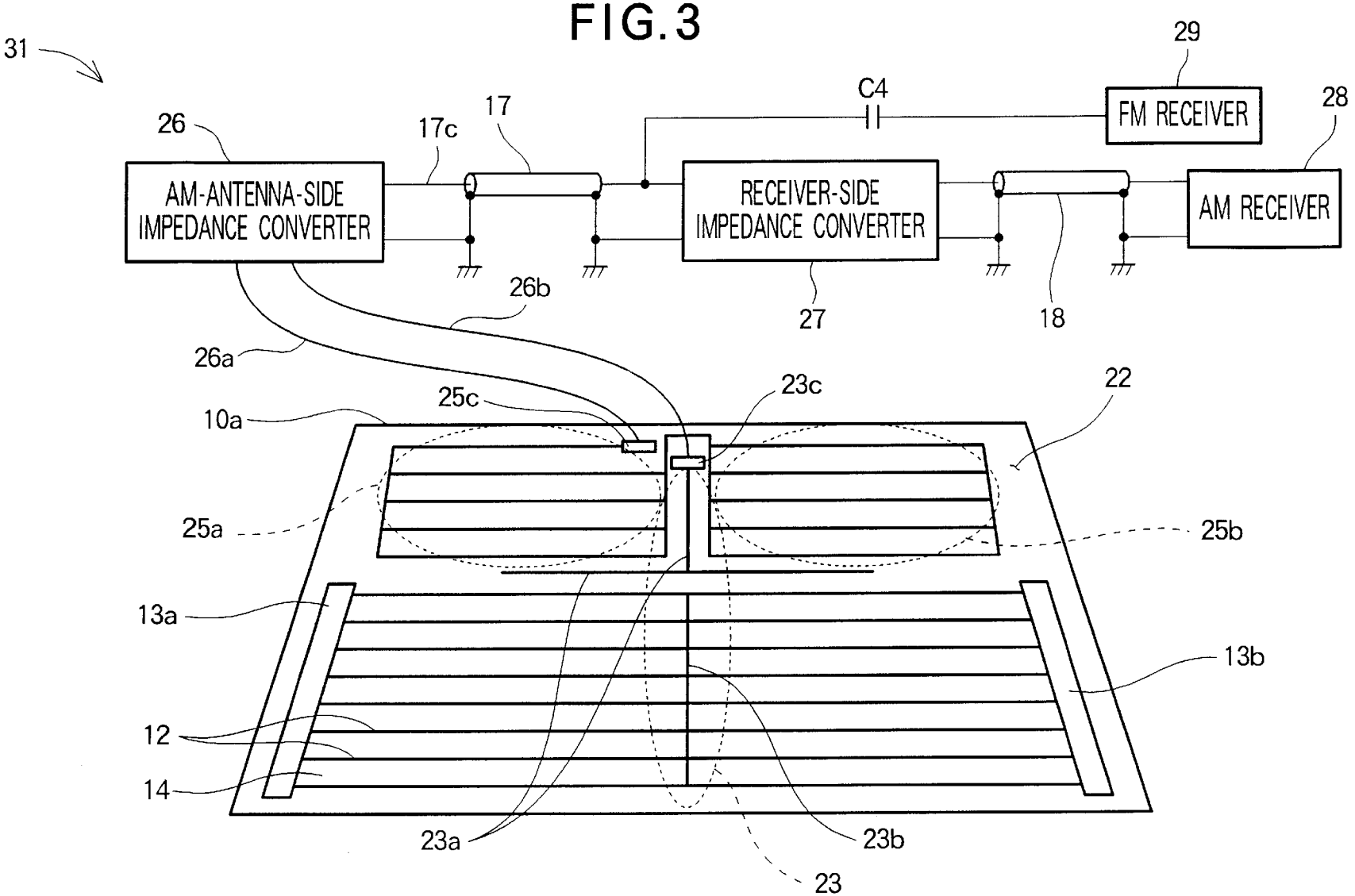
FIG. 3 is a diagrammatical view showing the general construction of a vehicle glass antenna device according to another embodiment of the present invention.
Figure 4:
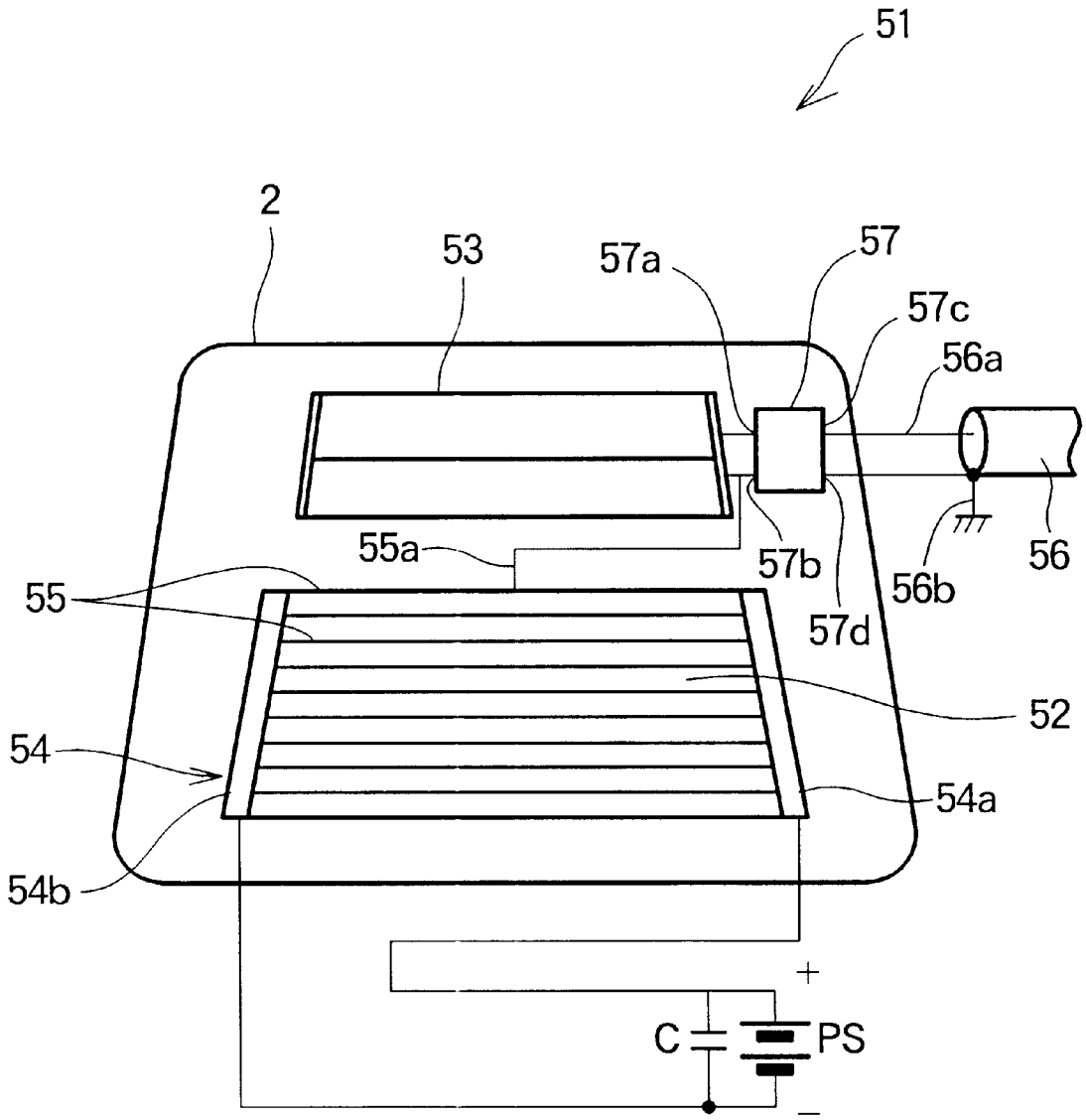
FIG. 4 (PRIOR ART)
FIG. 4 is a diagrammatical view showing the general arrangement of a conventional glass antenna device.

FIG. 3 diagrammatically shows the general arrangement of a vehicle glass antenna device according to another embodiment of the present invention.

The vehicle glass antenna device 31 includes an FM antenna pattern 23 having a first and a second FM antenna pattern parts 23*a* and 23*b*, and an AM antenna pattern 25 having first and second AM antenna pattern parts 25*a* and 25*b*, the AM and FM antenna patterns 23, 25 being formed on a window glass 22. The glass antenna device 31 further includes defogging heater strips 12 and a pair of bus bars 13*a*, 13*b* forming jointly with the heater strips 12 a defogger 14, an AM-antenna-side impedance converter 26 connected to an FM feeding point 23*c* and an AM feeding point 25*c*, a coaxial cable 17, a receiver-side impedance converter 27, a capacitor C4 for passing FM signals, a FM receiver 29, an coaxial cable 18 connected to the receiver-side impedance converter 27, and an AM receiver 28.

The AM-antenna-side impedance converter 26, the receiver-side impedance converter 27 and the coaxial cable 17 shown in FIG. 3 are the same as the AM-antenna-side impedance converter 6, the receiver-side impedance converter 7 and the coaxial cable 9, respectively, and further description thereof can be omitted.

In order to avoid direct coupling with the defogging heater strips 12, the FM antenna pattern 23 of the glass antenna device 31 is arranged such that the first FM antenna pattern part 23*a* has an inverted T shape including a vertical conductor pattern and a horizontal conductor pattern lying close to an uppermost one of the defogging heater strips 12, and the second FM antenna pattern 23*b* laid in an area of the window glass 22 in which the defogging heater strips 12 are arranged. With this arrangement, the first FM antenna pattern 23*a*, the second FM antenna pattern 23*b* and the uppermost defogging heater strip 12 form a capacitive coupling.

By properly selecting a line reduction rate which is determined by a capacitance value of the capacitive coupling formed between the uppermost defogging heater strip 12 and the horizontal conductor pattern of the first FM antenna pattern 23*a*, it is possible to make an input impedance of the defogging heater strips 12 extremely high.

Since the defogging heater strips 12 are in a condition separated from the second FM antenna pattern 23*b*, the reception sensitivity of the FM antenna pattern 23 is increased.

A reception signal from the AM antenna pattern 25 and a reception signal from the FM antenna pattern 23 are transferred in the form of a combined or synthetic reception signal from the AM-antenna-side impedance converter 26 through the coaxial cable 17 to the receiver-side impedance converter 27, then transmitted to the AM receiver 28 through the coaxial cable 18.

In this instance, the gain (reception sensitivity) of the AM antenna pattern 25 increases in direct proportion to the ratio between the antenna capacitance and the capacitance of the coaxial cable 17.

The reception signal from the AM antenna pattern 25 is transmitted to an input terminal 26*a* of the AM-antenna-side impedance converter 26. In the case where the AM-antenna-side impedance converter 26 is provided between the AM antenna pattern 25 and the coaxial cable 17, it is possible to reduce the capacitance of the coaxial cable 17 when viewed from the AM antenna pattern, thus reducing the transmission loss. In other words, by virtue of the AM-antenna-side impedance converter 26, the capacitance of the AM antenna pattern 25 is increased when viewed from the coaxial cable 17.

To improve the reception sensitivity of the AM antenna pattern 25, reduction of the antenna impedance is effectual. The antenna capacitance can be reduced by increasing the size and length of the conductor pattern of the AM antenna pattern 25. The line conductor pattern may be replaced by a transparent planar conductor pattern.

Furthermore, the reception sensitivity of the AM receiver can be increased by reducing the distributed capacitance of the coaxial cable 18 because attenuation of signals at a transmission line between the receiver-side impedance converter 27 and the AM receiver 28 decreases.

The reception signal from the FM antenna pattern 23 (which serves as an FM reception antenna) is transmitted to the terminal 26*b* of the AM-antenna-side impedance converter 26 (which performs the impedance conversion between the FM antenna pattern 23 and the coaxial cable 17). Then, the reception signal passes through the coaxial cable 17 connected to an output terminal 17*c* of the AM-antenna-side impedance converter 27, and after that the reception signal is supplied from an input terminal of the receiver-side impedance converter 27 to the FM receiver 29 through the capacitor C4.

Using the vehicle glass antenna device 31 shown in FIG. 3, a measurement was made for the AM reception sensitivity while varying the length (distributed capacitance) of the coaxial cable 18, so as to determine the relationship between the AM reception sensitivity and the frequency response. Results of this measurement are shown in Table 1 given below.

TABLE 1

AM RECEPTION SENSITIVITY
(AS COMPARED TO 900-mm-FENDER POLE ANTENNA)

UNIT: dB

| LENGTH OF COAXIAL CABLE | DISTRIBUTED CAPACITANCE | 666 kHz | 1035 kHz | 1458 kHz | MEAN VALUE |
|---|---|---|---|---|---|
| 0 cm (DIRECT CONNECTION) | 0 pF | −1.5 | −2.2 | −1.6 | −1.8 |
| 5 cm | 4 pF | −1.8 | −2.9 | −2.7 | −2.5 |
| 10 cm | 7 pF | −2.3 | −4.0 | −3.5 | −3.3 |

TABLE 1-continued

AM RECEPTION SENSITIVITY
(AS COMPARED TO 900-mm-FENDER POLE ANTENNA)

UNIT: dB

| LENGTH OF COAXIAL CABLE | DISTRIBUTED CAPACITANCE | 666 kHz | 1035 kHz | 1458 kHz | MEAN VALUE |
|---|---|---|---|---|---|
| 15 cm | 10 pF | −2.9 | −4.9 | −4.5 | −4.1 |
| 20 cm | 14 pF | −3.2 | −6.1 | −6.4 | −5.2 |

It appears clear from Table 1 that the AM reception sensitivity has a close relationship with the distributed capacitance of the coaxial cable because it decreases with an increase in the distributed capacitance.

The length of the coaxial cable 18 should preferably be as small as possible because an excessively long coaxial cable causes undue reduction in the AM reception sensitivity due to its correspondingly increasing distributed capacitance even though the transformers T1 and T2 undertake impedance matching of the AM broadcast signal at the AM signal transmission line to avoid desensitization.

As evidenced from Table 1, in the case of the coaxial cable consisting of a JIS (Japanese Industrial Standards) 1.5C2V coaxial cable, the length of this coaxial cable should preferably be not in excess of 15 cm (corresponding to the distributed capacitance of 10 pF) so that a reduction in the AM reception sensitivity can be maintained within −6 dB as compared to the AM reception sensitivity of a reference antenna.

The sensitivities shown in Table 1 are values as compared to the sensitivity of a 900-mm-length reference antenna consisting of a fender pole antenna of the vehicle. Stated in other words, the sensitivities shown in Table 1 are indicated in terms of the ratio of the receiver's input level of the reference antenna to the receiver's input level of the inventive antenna device.

As described above, because the coaxial cable interconnecting a receiver-side impedance conversion transformer and an input terminal of a receiver for the reception of AM broadcasts has a distributed capacitance not in excess of 10 pF, the vehicle glass antenna device of the present invention is able to reduce transmission loss at transmission lines, thus ensuring reception of AM signals at high sensitivity with little attenuation.

Obviously, various minor changes and modifications of the present invention are possible in the light of the above teaching. It is therefore to be understood that within the scope of the appended claims the present invention can be practiced otherwise than as specifically described.

What is claimed is:

1. A glass antenna device for a vehicle, comprising:

an FM antenna and an AM antenna both provided on the same surface of a window glass of the vehicle for the reception of FM broadcasts and AM broadcasts, respectively;

an antenna-side impedance conversion transformer connected to the FM antenna and the AM antenna through respective transmission lines for performing impedance conversion of the transmission lines;

a receiver-side impedance conversion transformer electrically connected to the antenna-side impedance conversion transformer; and a cable interconnecting the receiver-side impedance conversion transformer and the input terminal of a receiver for the reception of AM broadcast, the cable having a distributed capacitance not in excess of 10 pF.

2. A glass antenna device for a vehicle according to claim 1; further comprising a heater pattern comprising at least one conductive element provided on the surface of the same window glass as the AM antenna and the FM antenna for flowing a heat-generating current therethrough to defog the window glass.

3. A glass antenna device for a vehicle according to claim 2; wherein the heater pattern is separate from the AM antenna and the FM antenna.

4. A glass antenna device for a vehicle according to claim 2; wherein the heater pattern comprises a plurality of conductive elements disposed on the window glass, a first bus bar commonly connecting respective first ends of the conductive elements, a second bus bar commonly connecting respective second ends of the conductive elements, and a pair of terminals for supplying the heat-generating current to the conductive elements to defog the window glass.

5. A glass antenna device for a vehicle according to claim 1; wherein the antenna-side impedance conversion transformer is disposed externally of the window glass and has a primary winding having a first end connected to the AM antenna and a secondary winding having a first end connected to the FM antenna; and further comprising an inductor connected to second ends of the primary and secondary windings of the antenna-side impedance conversion transformer for presenting a high impedance to frequencies in the FM broadcast band to compensate for or offset a reduction in FM reception sensitivity resulting from distributed capacitances of the antenna-side impedance conversion transformer and cables.

6. A glass antenna device for a vehicle according to claim 5; further comprising a capacitor connected between the FM antenna and the secondary winding of the antenna-side impedance conversion transformer.

7. A glass antenna device for a vehicle according to claim 5; wherein the first end of the secondary winding of the antenna-side impedance conversion transformer is connected to the receiver-side impedance conversion transformer by a coaxial cable.

8. A glass antenna device for a vehicle according to claim 7; wherein the receiver-side impedance conversion transformer has a primary winding having a first end connected to the coaxial cable and a secondary winding having a first end connected to the cable having a distributed capacitance not in excess of 10 pF.

9. A glass antenna device for a vehicle according to claim 8; further comprising an inductor connected to second ends of the primary and secondary windings of the receiver-side impedance conversion transformer.

10. A glass antenna device for a vehicle according to claim 5; further comprising a capacitor and an inductor connected in series between the first ends of the primary and secondary windings of the receiver-side impedance conversion transformer.

11. A glass antenna device for a vehicle according to claim 1; wherein the AM antenna and the FM antenna are formed of one of conductive wire, conductive metal lines and conductive metal foil printed on the window glass.

12. A glass antenna device for a vehicle according to claim 1; wherein the cable connecting the receiver-side impedance conversion transformer and the input terminal of the receiver for the reception of AM broadcast signals comprises a coaxial cable having a distributed capacitance not in excess of 10 pF.

13. A glass antenna device according to claim 1; wherein a primary winding of the antenna-side impedance conversion transformer is connected to a feeding point of the AM antenna, and a secondary winding of the antenna-side impedance conversion transformer is connected to the FM antenna through a capacitor.

14. A glass antenna device according to claim 1; wherein the antenna-side impedance conversion transformer transmits received signals in the AM broadcast band.

15. A glass antenna device according to claim 1; wherein a ratio of turns of a primary winding and a secondary winding of the antenna-side impedance conversion transformer is 9:1.

16. A glass antenna device according to claim 1; wherein a ratio of turns of a primary winding and a secondary winding of the receiver-side impedance conversion transformer is 1:9.

17. A glass antenna device for a vehicle according to claim 1; wherein the AM antenna comprises a plurality of conductive elements disposed on the window glass, a first bus bar commonly connecting respective first ends of the conductive elements and a second bus bar commonly connecting respective second ends of the conductive elements.

18. A glass antenna device for a vehicle according to claim 1; wherein the FM antenna comprises an elongate conductor provided on the window glass.

19. A glass antenna device for a vehicle according to claim 1; wherein the AM antenna comprises an antenna pattern having a main strip extending along an outer periphery of the window glass and a plurality of parallel spaced-apart linear strips extending from the main strip, and the FM antenna comprises an antenna pattern having a single linear strip disposed within the main strip of the AM antenna pattern.

20. A glass antenna device for a vehicle comprising: an antenna provided on a surface of a window glass of the vehicle for the reception of radio broadcasts; an antenna-side impedance conversion transformer connected to the antenna through a transmission line for performing impedance conversion; a receiver-side impedance conversion transformer electrically connected to the antenna-side impedance conversion transformer; and a cable interconnecting the receiver-side impedance conversion transformer and the input terminal of a receiver for the reception of radio broadcast signals, the cable having a distributed capacitance small enough to prevent noise mixing and attenuation of radio broadcasts.

21. A glass antenna device for a vehicle according to claim 20; wherein the cable has a distributed capacitance no greater than 10 pF.

22. A glass antenna device for a vehicle according to claim 20; wherein the antenna comprises an AM antenna for the reception of broadcasts in the AM frequency band and a separately provided FM antenna for the reception of broadcasts in the FM frequency band.

23. A glass antenna device for a vehicle according to claim 22; wherein the antenna-side impedance conversion transformer is disposed externally of the window glass and has a primary winding having a first end connected to the AM antenna and a secondary winding having a first end connected to the FM antenna; and further comprising an inductor connected to second ends of the primary and secondary windings of the antenna-side impedance conversion transformer for presenting a high impedance to frequencies in the FM broadcast band to compensate for or offset a reduction in FM reception sensitivity resulting from distributed capacitances of the antenna-side impedance conversion transformer and cables.

24. A glass antenna device for a vehicle according to claim 23; further comprising a capacitor connected between the FM antenna and the secondary winding of the antenna-side impedance conversion transformer.

25. A glass antenna device for a vehicle according to claim 23; wherein the first end of the secondary winding of the antenna-side impedance conversion transformer is connected to the receiver-side impedance conversion transformer by a coaxial cable.

26. A glass antenna device for a vehicle according to claim 25; wherein the receiver-side impedance conversion transformer has a primary winding having a first end connected to the coaxial cable and a secondary winding having a first end connected to the cable interconnecting the receiver-side impedance conversion transformer and the input terminal of a receiver.

27. A glass antenna device for a vehicle according to claim 26; further comprising an inductor connected to second ends of the primary and secondary windings of the receiver-side impedance conversion transformer.

28. A glass antenna device for a vehicle according to claim 23; further comprising a capacitor and an inductor connected in series between the first ends of the primary and secondary windings of the receiver-side impedance conversion transformer.

* * * * *